United States Patent [19]

Elliott et al.

[11] 4,331,011

[45] May 25, 1982

[54] AUTOMATIC ROUGHING MACHINE

[75] Inventors: Richard M. Elliott, Beverly; Salvatore R. Provanzano, Melrose; Gordon V. Sprague, Jr., Danvers, all of Mass.

[73] Assignee: USM Corporation, Farmington, Conn.

[21] Appl. No.: 158,149

[22] Filed: Jun. 10, 1980

[51] Int. Cl.[3] ..... C14B 1/44; C14B 17/14; B24B 19/00

[52] U.S. Cl. ..... 69/6.5; 69/38; 51/247

[58] Field of Search ..... 51/247, 248; 69/6.5, 69/38

[56] References Cited

U.S. PATENT DOCUMENTS

| | | | |
|---|---|---|---|
| 2,558,811 | 7/1951 | Bernard | 69/38 |
| 3,704,604 | 12/1972 | Boot et al. | 69/6.5 |
| 4,126,020 | 11/1978 | Tutt et al. | 69/6.5 |

*Primary Examiner*—Patrick D. Lawson
*Attorney, Agent, or Firm*—Aubrey C. Brine

[57] ABSTRACT

A multi-station machine for marginal roughing and toe scouring of shoe bottoms has a turret arrangement, carrying a plurality of shoe supports. At a marginal roughing station two rotary roughing tools operate along opposite marginal portions, during movement of the tools lengthwise of the shoe bottom respectively in a first and a return direction, the shoe support being movable heightwise and widthwise of the shoe bottom so that each tool follows the shoe bottom margin contour. The tools can also pivot about a horizontal axis to maintain their plane normal to the shoe bottom portion being operated upon. In-machine brush grinding is provided, using rotating stones, the speed of rotation being about twice that of the roughing brushes, and the direction of rotation such that the peripheries of stone and brush, at the point of contact, move in the same direction. At a toe scouring station a single abrasive roll is movable lengthwise and heightwise of the shoe bottom under the control of a cam the angular disposition of which is set according to the shoe bottom contour. For controlling the movements of both the tools and shoe support at the marginal roughing station, servomotors are provided under the control of computer control means which supplies control signals thereto in accordance with a programmed instruction.

32 Claims, 6 Drawing Figures

1310
1300
1302
1304
1296
1316
1318
1314
1312
1298
1194
1204
1216
1276
1278
1268
1274
1272
1270
1236
1238
1240
1288
1306
1308
1300
1296
1288
1290
1294
1292
1280
1010
1196
1202
1254
1116
1118
1048
1038
1046
1018
1206
1242
1230
1232
1234
1266
1264
1260
1258
1260
1262
1256
1012
1190
1252
1250
1192
1110
1158
1156
1160
1174
1172
1144
1140
1138
1170
1168
C

AUTOMATIC ROUGHING MACHINE

BACKGROUND OF THE INVENTION

This invention relates to machines adapted for use in the manufacture of shoes, more particularly machines for operating, e.g., performing a roughing operation, progressively along marginal portions of shoe bottoms. The term "shoe" is used herein generically as indicating articles of outer footwear generally, including such articles in the course of their manufacture.

In one known machine for performing a roughing operation progressively along marginal portions of a shoe bottom, there are provided a shoe support, for supporting a lasted shoe, bottom uppermost, tool supporting means for supporting two rotary roughing tools in the form of wire brushes, and means for effecting relative movement, lengthwise of the bottom of a shoe supported by the shoe support, between the shoe support and the tool supporting means in one direction along a path, template means being provided, mounted on the shoe support, whereby, as relative lengthwise movement takes place as aforesaid, relative movement, widthwise of the bottom of a shoe supported by the shoe support, is also caused to take place between the shoe support and the tool supporting means, so that the tools supported by the tool supporting means can operate progressively along opposite marginal portions of the shoe bottom. Furthermore, in said machine, the tools are arranged in tandem relationship so that, as relative lengthwise movement takes place as aforesaid, first one tool engages the shoe bottom and operates along one marginal portion, and thereafter, following said one tool, the other tool engages the shoe and operates along the opposite marginal portion, the arrangement being such that the relative lengthwise movement is arrested when said other tool has completed its operation. Thereafter, with the tools in an out-of-the-way condition, relative lengthwise movement may then take place in an opposite direction along said path and the shoe can then be removed from the shoe support.

Whereas the machine referred to above operates satisfactorily on a variety of shoe styles and sizes, nevertheless it will be appreciated that the machine cycle includes a certain amount of "dead" time, in which the shoe bottom is not being operated upon but is merely being returned to a loading position. Furthermore, by arranging the tools in tandem relationship, the amount of relative lengthwise movement necessary for both brushes to traverse their respective marginal portions is greater than the overall length of the shoe, and this in turn leads to an extended machine cycle time.

Furthermore, the brushes always operate on the shoe bottom in the same direction, so that the "leading" edge of the operating surface of each brush is more subject to wear than the "trailing" edge of that surface, with the result that uneven brush wear takes place with consequent shortening of the effective life of the brush.

The use of template means in the aforementioned machine is highly efficient in ensuring that the path of relative movement followed by the roughing tools in relation to the shoe bottom being operated upon is closely controlled so that roughing of the shoe bottom is effected only in the areas intended to be roughed. This is of special importance in so far as any "over-roughing" of the shoe bottom, i.e. roughing beyond the featherline, will be visible in the finished shoe (unless of course the shoe construction requires such "overroughing", e.g. if the shoe unit to be applied extends up the sides of the finished shoe, in which case the machine employing the templates means can be so set to control the degree of "over-roughing"). Similarly, "under-roughing" may provide an insufficient area of roughed material to ensure a good bond with the sole unit to be attached; furthermore, "under-roughing" means that the area of rough does not extend up to the featherline, so that gapping may arise in the finished shoe between the attached sole unit and the lasted-over portions of the upper.

Template means do, however, present a problem of storage, especially in cases where one template is provided for each size, or perhaps for two or three half-sizes, of a given style. To overcome this problem, it has been proposed to use a single, adjustable template for each style, but such an arrangement has not proved satisfactory. Furthermore, in other machines for performing a roughing operation progressively along marginal portions of shoe bottoms, in order to avoid the use of template means, it has been proposed to use the edge of the shoe itself for purposes of guiding the tool(s). However, problems may arise in such a case in that, especially in the instep region of the shoe bottom, the edge of the shoe bottom may be insufficiently defined satisfactorily to guide a tool along the shoe bottom marginal portion.

Furthermore, prior to effecting a marginal roughing operation, whether by one or other of the aforementioned machines or whether by hand, it is customary first to remove any significant pleats which have been formed, during the preceding lasting operation, especially at the toe end of the shoe, such removal generally being effected using a rotating toe scouring roll or a toe scouring band to which the shoe bottom is presented manually. At least when using the machine first mentioned above, this manual toe scouring operation can be effected during the marginal roughing machine cycle without significantly affecting the cycle time. However, if the cycle time were to be shortened to any significant extent, then manual toe scouring could no longer be effected.

Again, in the machine first mentioned above means is provided for maintaining the brushes in a sharpened condition, said means including stationary grinding stones contoured to the desired shape of the operating surface of each brush. In using such means, in order that the burrs formed during sharpening will be directed so as to improve the cutting effect of the brush during the roughing operation, it is necessary to reverse the direction of rotation of each brush for the grinding operation. After grinding, of course, the direction of rotation has to be once more reversed back to the "roughing" direction. To this end, clearly a reversible motor has to be used for the rotation of each brush. Furthermore, since grinding takes place relatively frequently (e.g. desirably once every 20 or so machine cycles), the constant starting and stopping of the motor tends to shorten the life of the motor. Again, because of the need to reverse the direction of rotation of each brush twice for each grinding operation, a good deal of operating time is lost for each grinding operation.

OBJECTS OF THE INVENTION

It is therefore an object of this invention to provide an improved machine for operating progressively along marginal portions of shoe bottoms, in the operation of which machine the cycle time is reduced, thereby giving rise to an improved output.

It is another of the objects of this invention to provide an improved machine for operating progressively along marginal portions of shoe bottoms, in which machine means is provided for guiding a tool or tools along opposite marginal portions of the shoe bottom but without the need for separate template means for each size of each style of shoe.

It is still another object of this invention to provide an improved machine for performing a roughing operation progressively along marginal portions of shoe bottoms, in the operation of which machine grinding can take place more efficaciously not only in terms of the time required, but also in terms of improved exploitation of the various integers of the machine.

It is a still further object of this invention to provide an improved machine for performing marginal roughing and also toe scouring operations on shoe bottoms, in the operation of which machine toe scouring can be performed automatically in the machine cycle.

SUMMARY OF THE INVENTION

With the above and other objects in mind, the invention provides a machine for performing a roughing operation progressively along marginal portions of shoe bottoms comprising a shoe support, tool supporting means, means for effecting relative movement, lengthwise of the bottom of a shoe supported by the shoe support, between said shoe support and the tool supporting means first in one direction and then in an opposite direction, and means, operable as relative lengthwise movement takes place as aforesaid, for effecting relative movement, widthwise of the bottom of a shoe supported by the shoe support, between said shoe support and the tool supporting means, whereby, in the operation of the machine, a roughing operation can be progressively performed along marginal portions of such shoe bottom, wherein the tool supporting means is arranged to support two radial roughing tools for operating along opposite marginal portions of the shoe bottom, each tool being caused to effect an in-wiping action on the marginal portion on which it is caused to operate, and further wherein, in a cycle of operation of the machine, one of said tools is caused to operate along the marginal portion of the shoe bottom at one side thereof during relative lengthwise movement as aforesaid in said one direction, and the other of said tools is caused to operate along the marginal portion of such shoe bottom at the opposite side thereof during said relative lengthwise movement in said opposite direction.

In this way, it will be appreciated that the cycle time of the machine in accordance with the invention is reduced (as compared with that of the machine first mentioned above), in so far as the amount of relative lengthwise movement required can be reduced since the brushes need no longer be arranged in a tandem relationship. Indeed, the brushes are preferably arranged side-by-side, conveniently on a single support member.

The above arrangement, furthermore, lends itself to the use of computer control means, and to this end the invention also provides a machine for operating progressively along marginal portions of shoe bottoms comprising a shoe support for supporting a shoe, bottom uppermost, with a marginal portion to be operated upon of the bottom thereof exposed, tool supporting means for supporting an operating tool, a first servomotor for effecting relative movement, lengthwise of the bottom of a shoe supported by the shoe support, between said shoe support and the tool supporting means, a second servomotor for effecting relative movement, widthwise of such shoe bottom, between the shoe support and the tool supporting means, and a third servomotor for effecting relative movement, heightwise of such shoe bottom, between the shoe support and the tool supporting means, the machine also comprising computer control means for controlling the operation of each servomotor in accordance with digitised co-ordinate axis values, using three co-ordinate axes, for a plurality of successive selected points along the marginal portion to be operated upon of a shoe bottom.

In this way, separate templates are no longer required for each size of each style of shoe bottom, but rather the facility can be provided for feeding digitised information concerning a style to the computer control means, and said control means may also be provided with a grading programme whereby the path of relative movement between the tool supporting means and the shoe support can be graded for each shoe size within the style, e.g. by "reading" the length of the shoe when it is initially supported in the shoe support.

Further to improve the cycle time of the machine in accordance with the invention, more especially with regard to the grinding operation, the invention further provides a machine for performing a roughing operation progressively along marginal portions of shoe bottoms comprising a shoe support, tool supporting means for supporting a roughing tool in the form of a rotary wire brush, and means whereby relative movement can take place, in directions extending lengthwise, widthwise and heightwise of the bottom of a shoe supported by the shoe support, between the tool supporting means and the shoe support whereby a tool supported by the tool supporting means can operate progressively along the bottom of a shoe supported by the shoe support, wherein grinding means is provided by which the operating surface of the roughing tool can be ground to maintain its roughing capability, the grinding means comprising a rotary grinding member, and further wherein first and second drive means are provided for causing the tool and the grinding member respectively to rotate, the arrangement being such that, at the point of engagement between the tool and the grinding member, the operating surfaces thereof are moving in the same direction, but the speed of the surface of the grinding member is greater than that of the surface of the tool.

In this way, furthermore, not only is the time required for the grinding operation reduced, but by no longer requiring that the direction of rotation of the brushes be reversed twice for each grinding operation, the life of the motors by which the brushes are caused to rotate is also significantly improved.

Again, in order not to adversely affect the cycle time, by the operator being required to perform a toe scouring operation manually between initiation of successive roughing cycles, the invention still further provides a machine for performing marginal roughing and also toe scouring operations on shoe bottoms, comprising a shoe support and roughing tool supporting means, between which relative movement can take place, in directions extending lengthwise, widthwise and heightwise of the bottom of a shoe supported by the shoe support whereby a roughing tool supported by the roughing tool supporting means can be caused to operate progressively along a marginal portion of the bottom of a shoe supported by the shoe support, the machine also comprising scouring tool supporting means between which and the shoe support relative movement can also take place in directions extending lengthwise and heightwise of the bottom of a shoe supported by the shoe support, means also being providing, responsive to the heightwise contour of the toe portion of the shoe bottom, for controlling the relative heightwise movement between the shoe support and the scouring tool supporting means, as relative lengthwise movement is caused to take place therebetween.

In one convenient construction of machine there are provided a rotary turret arrangement carrying a plurality of shoe supports each capable of supporting, bottom up, a lasted shoe, means for indexing the turret to bring each shoe support successively to a series of operating stations, including a roughing station at which a roughing operation can be performed progressively along opposite marginal portions of the bottom of a lasted shoe supported by the shoe support at said station, said station comprising tool supporting means by which a radial roughing tool can be supported and means for moving the tool supporting means relative to the shoe support in a direction extending lengthwise of the shoe bottom, and wherein the shoe support is mounted on the turret for movement relative thereto in a direction extending widthwise of the shoe bottom, whereby, in the operation of the machine, the tool supported by the tool supporting means is caused to operate progressively along a marginal portion of the bottom of the shoe supported by the shoe support. Furthermore, another of the operating stations is a scouring station which is arranged "upstream" of the roughing station and at which the toe portion of a lasted shoe can be scoured by means of a rotary scouring tool, means being provided for effecting relative movement between said scouring tool and the shoe support in a direction extending lengthwise of the shoe bottom.

It will be appreciated that, while the invention is described in this specification in relation to a machine for performing a roughing operation on shoe bottoms, it may be further applicable, in many of its aspects, to other machines for operating along marginal portions of shoe bottoms, e.g. shoe bottom cementing machines.

BRIEF DESCRIPTION OF THE DRAWINGS

There now follows a detailed description, to be read with reference to the accompanying drawings, of one machine in accordance with the invention, this one machine having been selected for description merely by way of exemplification of the invention and not by limitation thereof. In the accompanying drawings.

DESCRIPTION OF THE PREFERRED EMBODIMENT

The machine now to be described is a machine suitable for use in performing roughing and scouring operations on shoe bottoms, more especially for performing a roughing operation progressively along marginal portions of shoe bottoms and further for scouring shoe bottoms in the toe and forepart regions thereof. The machine is a four-station machine, providing a loading station A, a toe scouring station B, a marginal roughing station C and a fourth station D, which could be used for marginal cementing of the shoe bottom after roughing or merely for shoe unloading. (Marginal cementing parts will not be herein described.)

Figure 1:
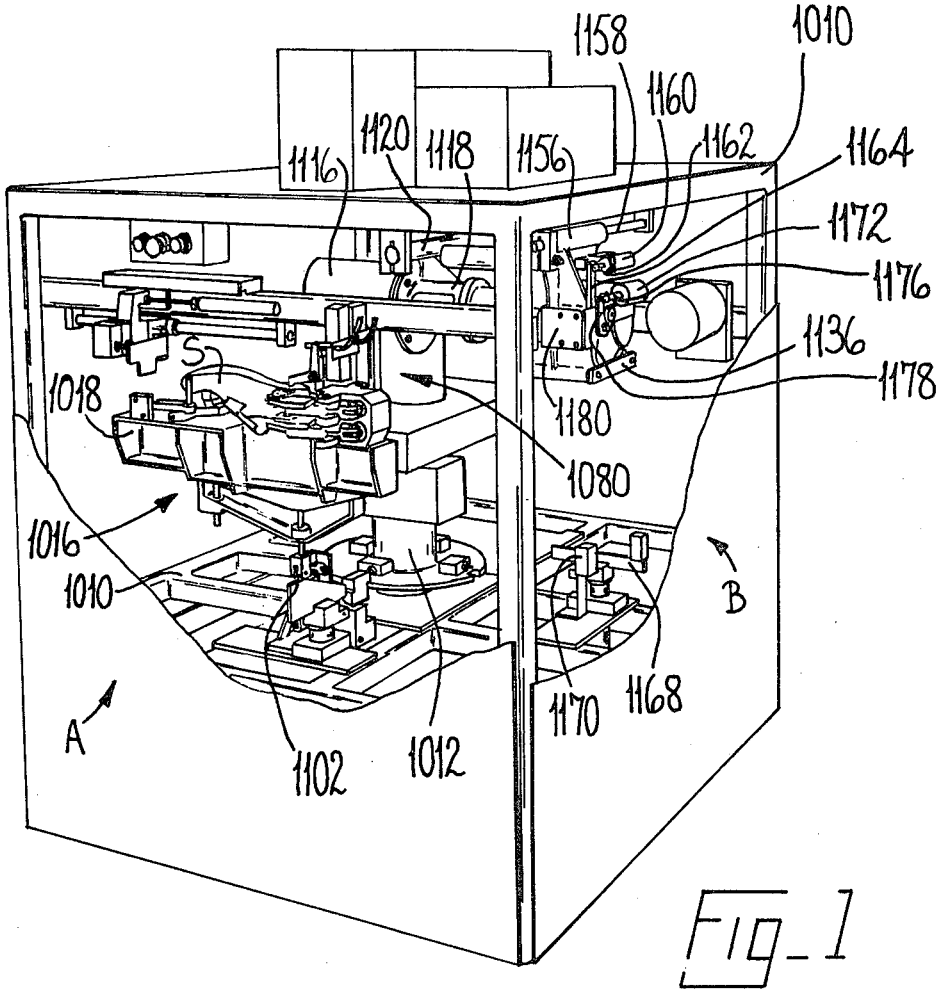
FIG. 1 is a front perspective view of the machine in accordance with the invention, showing especially a loading station thereof.

The machine comprises a main frame 1010 in which is supported, for rotation about a vertical axis, a turret arrangement 1012, drive means (not shown) being provided for causing the turret arrangement 1012 to index through 90° once in each cycle of operation of the machine. At its upper end the turret arrangement 1012 has four arms equally spaced at right angles to the vertical axis about which the turret arrangement pivots, each arm carrying a shoe support generally designated 1016, by which a shoe S can be supported, bottom uppermost, for scouring and roughing operations to be performed on the bottom thereof. (For convenience sake only one of the four shoe supports is shown in FIG. 1.)

Figure 2:
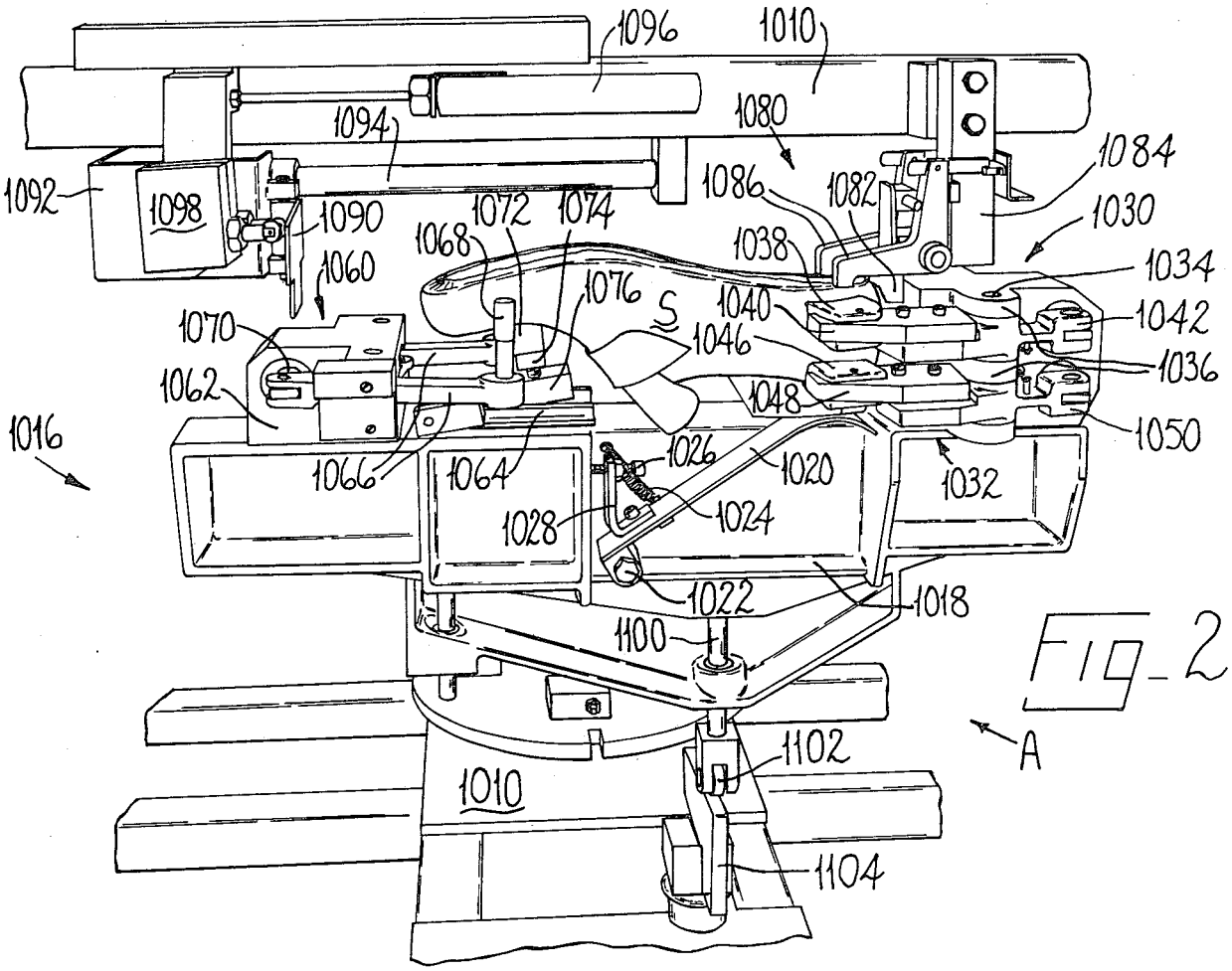
FIG. 2 is a front perspective view of said station, showing details of a shoe support of said machine with a shoe supported, bottom uppermost, thereby.

The shoe supports 1016 are all similar, and one only will now be described with reference to FIG. 2. The shoe support 1016 comprises a casting 1018 carried on its associated arm and in turn supporting a shoe heel support member 1020 for pivotal movement about a pivot pin 1022, a spring 1024 acting on said support member to urge it upwardly into an operative position, which is determined by an adjustable stop screw 1026 carried on a bracket 1028 of said member and arranged to abut against a wall portion of the casting 1018. If the shoe to be supported is a boot having an elongated leg portion, so that the member 1020 impedes the leg portion of the boot, which can otherwise hang down through the casting 1018, the member can be pivoted about the pin 1022 downwardly to an out-of-the-way position, the spring 1024 thereby passing over the axis of the pin and thus serving to maintain the member in its out-of-the-way position.

The casting 1018 supports heel clamping means comprising a first set of clamps 1030 and a second set of clamps 1032. The first set of clamps 1030 is arranged to clamp the heel end of a shoe S close to, but slightly below, the featherline thereof, while the second set of clamps 1032 is arranged to clamp said shoe adjacent to topline region thereof.

The first set of clamps 1030 are mounted for pivotal movement on pins 1034 mounted in outwardly extending lateral lug portions 1036 of the casting. Each clamp comprises a clamp pad 1038 mounted for limited pivotal movement in a support 1040 therefor, each such support being carried by an arm 1042 of the first set of clamps. Rearward end portions of the arms 1042 are spring-urged towards one another thus to urge the clamp pads 1038 apart. For urging said clamp pads together, a piston and cylinder arrangement (not shown) acts between said rearward end portions of the arms 1042, thus to cause a shoe placed in the shoe support to be clamped by the clamp pads 1038. Furthermore, a link (not shown) between the pair of arms 1042 ensures that the arms remain equi-distant from the shoe support 1016 centerline, so that, upon the upper clamps 1030 clamping the heel end of a shoe supported in the shoe support, said heel end is centralized in said support.

The second set of clamps 1032 are also mounted for pivotal movement about the pins 1034, each clamp comprising a clamp pad 1046 mounted for limited pivotal movement in a support 1048 therefor, each support being carried by an arm 1050. Rearward end portions of the arms 1050 are spring-urged towards one another thus to urge the clamp members 1046 apart. For urging the clamp members 1046 towards one another, a piston and cylinder arrangement (not shown) acts between said rearward end portions, thereby causing the clamp pads 1046 to be moved inwardly to engage a shoe S positioned in the work support and to clamp it therein. Unlike the upper clamps 1030, the lower clamps 1032 do not serve to centralize the heel end of the shoe, but merely clamp it without displacing it.

For supporting the toe end portion of the shoe S the bottom of which is to be roughed, the shoe support 1016 also comprises toe support means generally designated 1060, said means comprising a support casting 1062 which is slideable on a rail member 1064 secured on an upper surface of the casting 1018 of the shoe support, means (not shown) comprising a piston and cylinder arrangement being provided for effecting sliding movement of the support casting 1062 towards the heel support arrangement described above. The support casting 1062 supports two heelwardly extending arms 1066, each having at its heelward end an upstanding pin 1068, the arrangement being such that the toe end of the shoe S can be engaged by said pins, when they are moved to an operative position. For so moving the pins, a piston and cylinder arrangement 1070 is arranged to act between ends of the arms 1066 remote from the pins 1068, the arrangement being such that the pins 1068 move inwardly through the same distance, thus to centralize the toe end of the shoe S in the shoe support. This is achieved by the provision of intermeshing lugs (not shown) formed on the arms 1066.

For establishing a height datum for the toe end of the shoe S, furthermore, a toe rest member 1072 (FIG. 4) is mounted on the support casting 1062, said member comprising a rubber pad secured on a block 1074 threadedly secured, for heightwise adjusting movement of the toe rest member, in a carrier 1076 therefor, said carrier being supported by the support casting 1062 for lengthwise movement to accommodate different sizes of shoe. The carrier 1076 has a cam roll (not shown) which rides on a slightly inclined plane so as to gradually raise the block 1074 and carrier 1076 as the casting 1062 is moved to the right to accommodate smaller shoes.

The loading station A of the machine also has means for determining the height of the heel seat portion of the shoe S to be treated when supported in the shoe support 1016 at the loading station, said means comprising a holddown arrangement 1080 arranged to overlie the heel support member 1020 when in its operative position, said arrangement providing the height datum of the shoe bottom at the heel end. The holddown arrangement 1080 comprises a lipped member 1082 which is arranged to engage the shoe S in the backseam region thereof and has a lip which overlies the shoe bottom in said region, thus to provide the height datum. The lipped member 1082 is mounted on a bracket 1084 secured to the main frame 1010 of the machine at the loading station. For ensuring that the shoe bottom is level in the heel seat region thereof, furthermore, associated with the holddown arrangement are two bell crank levers 1086 arranged at opposite sides of the lipped member 1082 and pivotally mounted on said bracket 1084, one arm of each bell crank lever having a downwardly facing shoe bottom-engaging surface. The other arm of each bell crank lever has photoelectric sensing means associated therewith, the arrangement being such that, when the shoe bottom is in a level position, a photocell (not shown) associated with each of the arms is blocked from a light source therefor, and a "shoe bottom level" signal is provided, for purposes to be hereinafter described.

The loading station A of the machine further comprises means for sensing the length of the shoe S to be operated upon, when said shoe is clamped as aforesaid by the shoe support at said station. Said means comprises a plate 1090, which is mounted on a slide 1092 arranged to slide along a support rod 1094 under the action of a piston and cylinder arrangement 1096. The plate 1090 is mounted for pivotal movement about a vertical axis on said slide. Also carried by the slide are two switches 1098 wired in series, the actuators of which are arranged immediately behind (in the direction of movement of the plate towards the shoe) said plate. Thus, when the shoe is clamped as aforesaid in the shoe support, the piston and cylinder arrangement 1096 is actuated and the plate is caused to engage with the toe end, the plate thereafter being pivoted about its hinge to actuate the microswitches 1098. Such actuation causes the condition of an encoder (not shown) associated with the slide 1092 to be recorded, the arrangement being such that the condition of the encoder is related to the length of the shoe clamped by the shoe support; in this way, the length of the shoe is "read", for purposes which will be referred to hereinafter. Actuation of the microswitches 1098 is further effective to cause the operation of the piston and cylinder arrangement 1096 to be reversed, whereupon the slide 1092 is returned to its initial, out-of-the-way position.

The shoe support 1016 is supported by its associated arm for controlled heightwise movement relative to the arm. For controlling the heightwise position, the shoe support casting 1018 has a rod 1100 depending therefrom, said rod carrying a roll 1102 which engages with a height-setting plate 1104 mounted on the main frame 1010 of the machine.

Figure 3:
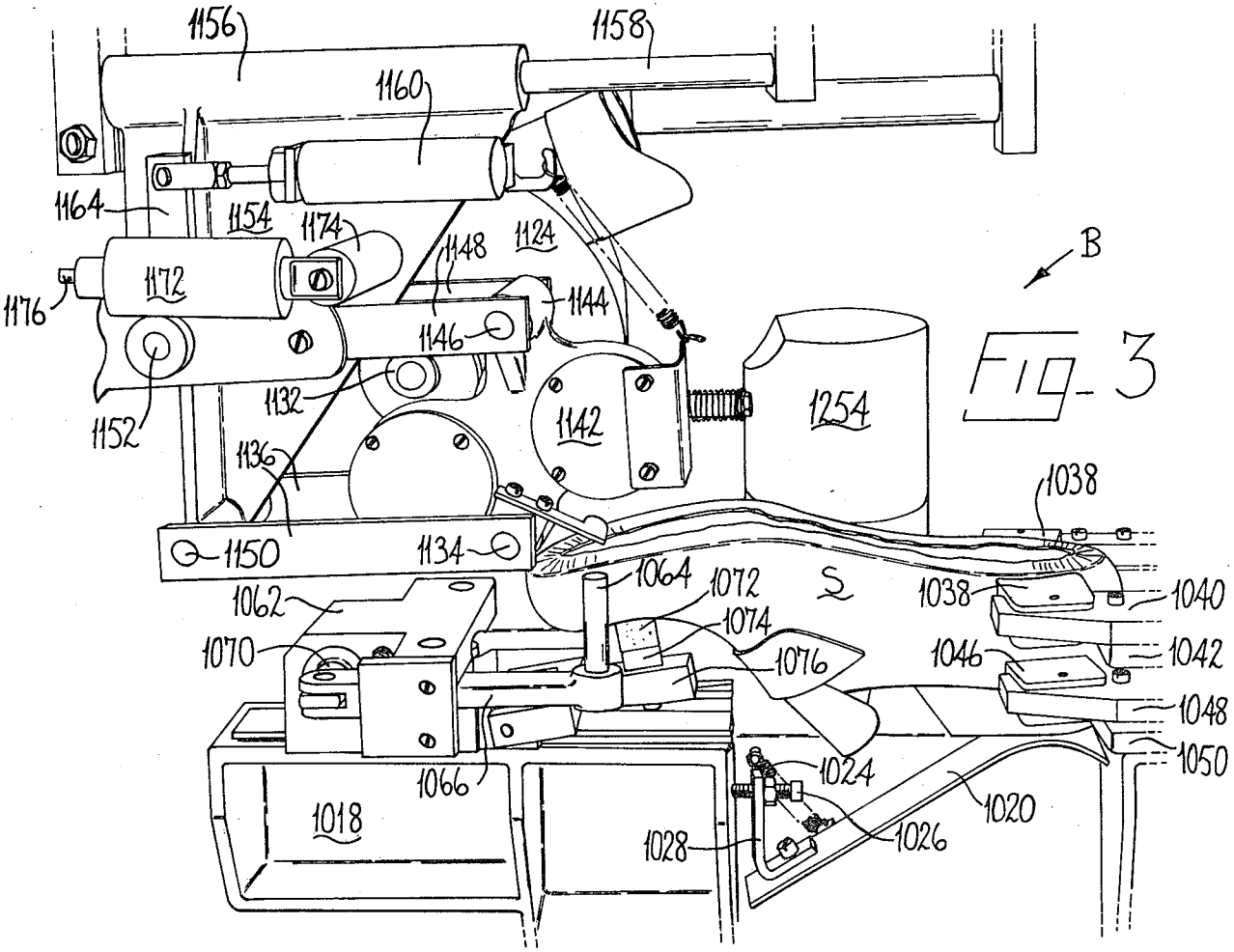
FIG. 3 is a detailed perspective view of a toe scouring station of the machine, when the shoe the toe of which is to be scoured has first arrived at said station.
Figure 4:
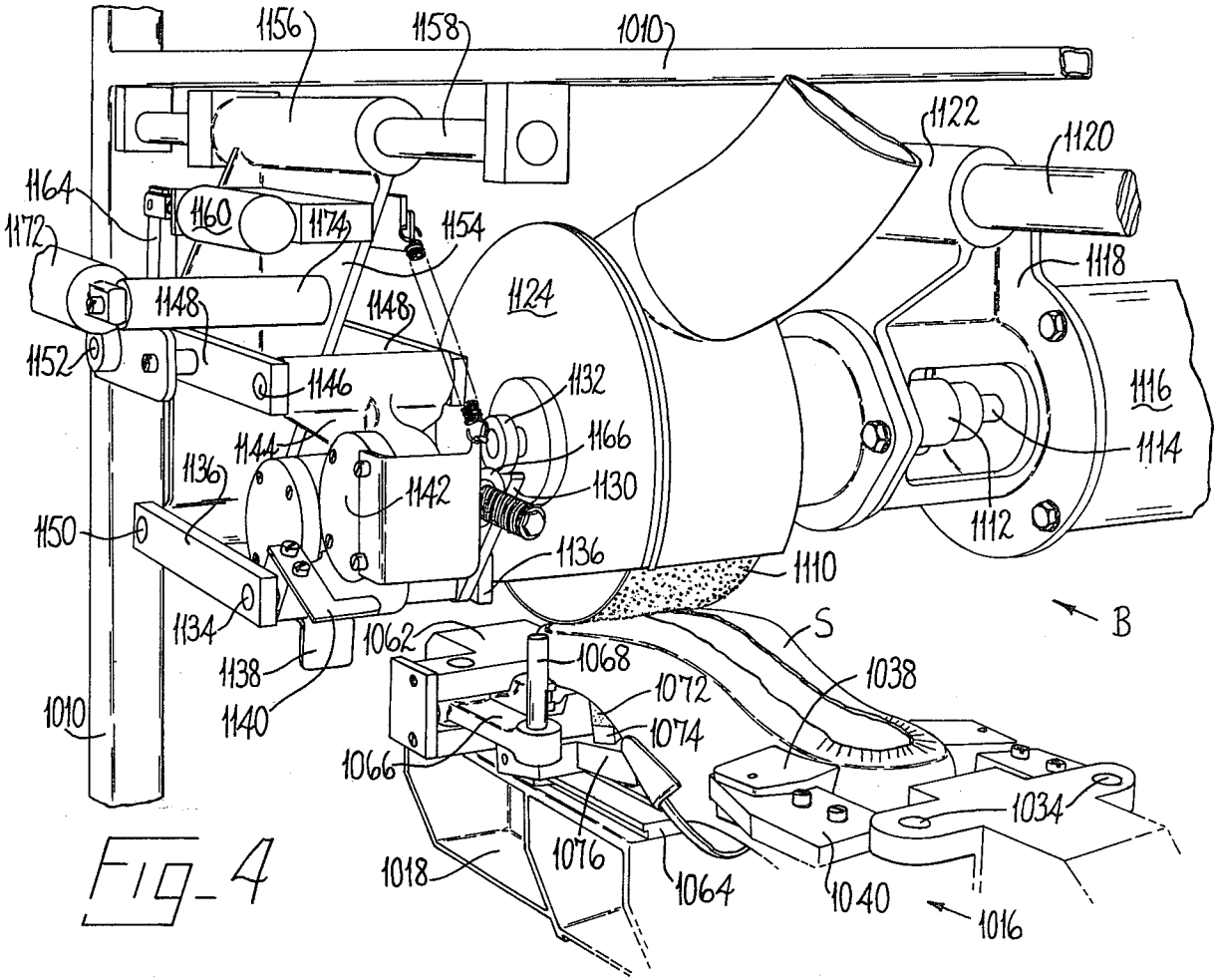
FIG. 4 is a fragmentary perspective view of the toe scouring station during the toe scouring operation.

Referring to FIGS. 3 and 4, the toe scouring station B of the machine comprises a toe scouring roll 1110, which may be of "Tygrit" or the like, mounted on a shaft (not shown) and coupled, by two universal couplings 1112 (one only shown in FIG. 4), to the output drive shaft 1114 of a motor 1116, the roll, shaft and motor all being supported on a centrally disposed support casting 1118 which is slideable, in a direction extending lengthwise of a shoe supported at the toe scouring station, along a slide rod 1120 secured to the main frame of the machine, the support casting having an integral tubular slide portion 1122 carried on said slide rod. The universal couplings 1112 serve to enable the scouring roll 1110 to move heightwise in relation to the bottom of a shoe being operated upon, relative to the motor. Also secured on the support casting 1118 is a housing 1124 which surrounds all but an operative portion of the surface of the scouring roll, said housing also forming part of a dust extraction system for removing scoured-away particles from the operating locality, and also from the atmosphere.

In the operation of the machine, the scouring roll is caused to move heightwise as aforesaid, as it is moved in a direction lengthwise of the shoe bottom, by means of a cam 1130, the angular disposition of which has been previously set automatically according to the angle between the forepart portion of the shoe bottom and the horizontal, the shaft on which the scouring roll is supported carrying a cam follower 1132 for this purpose. For setting the angular disposition of the cam 1130, said cam is mounted on a shaft 1134 extending between two parallel links 1136, said shaft 1134 also supporting a shoe-engaging member constituting means for "reading" the angle of inclination of the toe end of the shoe. Said shoe-engaging member comprises a downwardly extending plate portion 1138, by which the toe end of the shoe to be operated upon is contacted, and, at an angle of approximately 75° to said plate portion, a further plate portion 1140 which is generally L-shaped and the bottom of which L is arranged to engage with the forepart of the insole of the shoe to be operated upon. Thus, when said shoe-engaging member engages a shoe, it is pivoted on the shaft 1134, thus to accommodate to the style of shoe, such pivoting movement also serving to position the cam 1130 for the subsequent scouring operation. Once the shoe-engaging member and cam have been positioned, a pneumatic locking device generally designated 1142 supported on a casting 1144 is provided, whereby the shoe-engaging member and cam are locked in adjusted position.

The casting 1144 is supported on the shaft 1134 and also on a further shaft 1146 itself supported by two further parallel links 1148. The parallel links 1136, 1148 form a parallel linkage arrangement, opposite ends of said links being supported on shafts 1150, 1152 respectively carried in a web portion 1154, which is carried, by means of an integral slide portion 1156, on a slide rod 1158 supported on the main frame of the machine.

For bringing the shoe-engaging member into engagement with the shoe bottom, the casting 1144, and thus the shaft 1134 and the shoe-engaging member therewith, are lowered through the parallel linkage arrangement by means of a piston and cylinder arrangement 1160 mounted on the web portion 1154 and having a piston rod 1162 (FIG. 1) connected to a link 1164 secured to the shaft 1150. Thus, actuation of said piston and cylinder arrangement is effective through said link to cause the shaft 1150 to rotate, thereby operating the parallel linkage arrangement.

Furthermore, for positioning the shoe-engaging member, and also the toe scouring roll, according to the size of shoe to be operated upon, means (not shown) including a piston and cylinder arrangement is provided for moving the slide portions 1122, 1156, and the various integers supported thereby, in a direction extending lengthwise of the shoe bottom, in order to position the shoe-engaging member so as to be able to engage the shoe bottom, and also to position the toe scouring roll for the subsequent toe scouring operation.

A further pneumatically operated locking device 1166 is provided on the casting 1144 whereby the web portion 1154, and thus the integers supported thereby, are locked in adjusted position, prior to initiation of the toe scouring operation itself.

It will be apparent from FIGS. 3 and 4 that the shoe-engaging member is mounted further from the centre of the turret arrangement 1012 than the scouring roll. In the operation of the machine, the shoe support 1016 carries the shoe S to be operated upon firstly to a position in which the toe end of said shoe may be engaged by the shoe-engaging member and thereafter, after the locking device 1166 has been operated to secure the slide portion 1156 in position as aforesaid, the shoe support 1016 is moved inwardly of the turret to bring the toe end portion of the shoe S to a position in which it can be operated upon the scouring roll. For this purpose, as shown in FIG. 1, the roll 1102 rides on a rail 1168 of the toe scouring station B, a microswitch 1170 being provided which is tripped when the shoe support reaches a position of alignment with the toe scouring roll. The rail also serves to determine the height of the shoe support 1016 at the toe scouring station.

Means is also provided, comprising a piston and cylinder arrangement 1172 mounted, through a spacer 1174 on the web portion 1154, for moving the slide portion 1122, and thus the toe scouring roll 1110, relative to the shoe-engaging member and cam 1130, thus to effect the toe scouring operation. To this end, said piston and cylinder arrangement comprises a piston rod 1176 which is pivotally connected to a bracket 1178 (FIG. 1) supported on a carrier 1180 therefor itself connected, by a linkage (not shown), to the support casting 1118 associated with the toe scouring roll. Thus, actuation of the piston and cylinder arrangement 1172 is effective to move the toe scouring roll to cause a toe scouring operation to be performed, the cam follower 1132 running up the cam 1130, which latter is stationary, thus to cause the toe scouring roll to be raised according to the angle of inclination of the shoe bottom over the forepart portion which is scoured. It will be appreciated that the toe scouring operation is effective to remove pleats formed in the lasting margin in the toe region of the shoe bottom.

Figure 5:
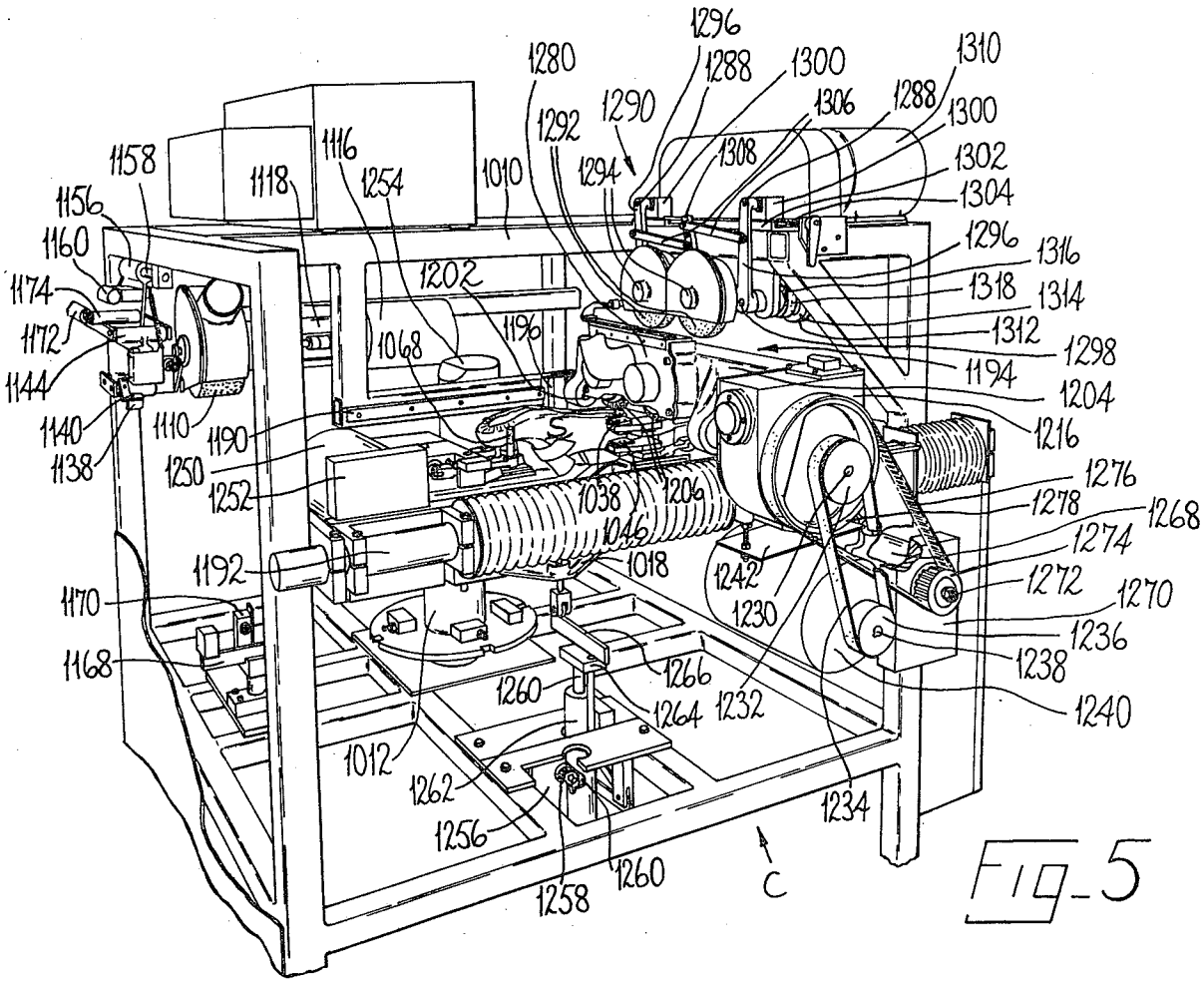
FIG. 5 is a perspective view of a marginal roughing station.
Figure 6:
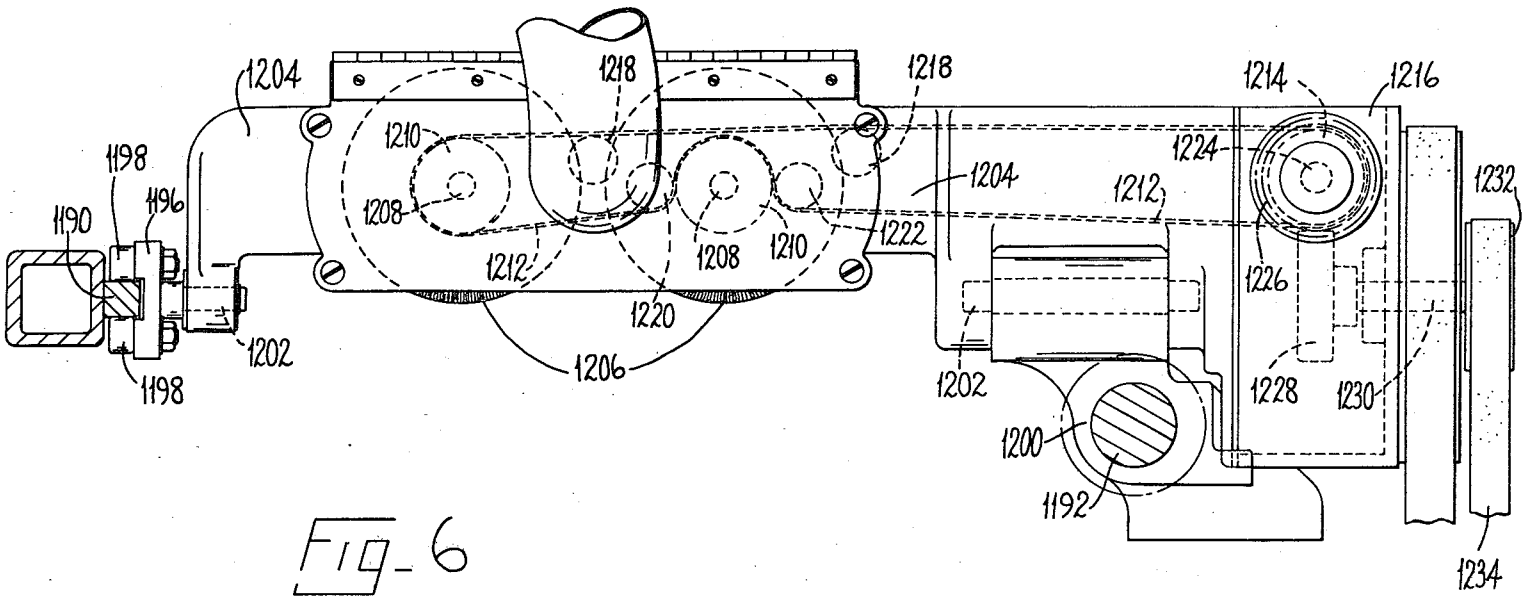
FIG. 6 is an elevational view, partly in section, of tool supporting means at said marginal roughing station, showing details of drive means for the tools.

Referring now to FIGS. 5 and 6, at the marginal roughing station C of the machine is mounted a support arrangement comprising two rails 1190, 1192 for supporting tool supporting means generally designated 1194 of the machine, said rails being carried on the main frame of the machine and extending in directions extending lengthwise of the bottom of the shoe S to be operated upon at that station. The rail 1190 is of square cross section and supports a carrier block 1196 which is provided with four rolls 1198, running two on an upper surface and two on a lower surface of said rail. The rail 1192 is of circular cross-section and supports a carrier block 1200 in the form of a slide bearing member embracing the rail 1192. The carrier blocks 1196, 1200, which form part of the tool supporting means of the machine, each support a fulcrum shaft 1202, extending on a common axis, said shafts supporting in turn a support bridge 1204 in the form of a hollow casting. At the end of said bridge, nearer the carrier block 1196, are supported, side-by-side, two rotary radial roughing brushes 1206. Each brush 1206 is fixed on a spindle 1208 which is supported in the support bridge and also which carries a pulley portion 1210. For driving the brushes, a drive belt 1212 passes round a drive pulley 1214 arranged in a housing 1216 at one side of the support bridge 1204, the drive belt passing also over two tension pulleys 1218, around the pulley portion 1210 associated with the brush 1206 remote from the drive pulley 1214, over a pulley 1220, around the pulley portion 1210 associated with the other roughing brush 1206, and over a further pulley 1222 back to the drive pulley 1214. The arrangement of the pulleys is such that the two brushes are thus driven by a single drive belt in contrary directions. The drive pulley 1214 is supported on a shaft 1224 which carries a bevel gear 1226 meshing with a further bevel gear 1228 mounted on a shaft 1230 extending transversely of the shoe bottom, the axis of said shaft being conincident with that of the fulcrum shafts 1202. The shaft 1230 carries a drive pulley 1232 connected by a drive belt 1234 to a further drive pulley 1236 carried on an output drive shaft 1238 of a motor 1240. The motor is supported on a bracket 1242 secured beneath the carrier block 1200 of the tool supporting means.

The tool supporting means is movable along the rails 1190, 1192 under the control of a first servomotor 1250 which is mounted on a plate 1252 secured on the main frame 1010. The servomotor carries on its output drive shaft a toothed drive pinion (not shown) meshing with a rack (also not shown) connected to the carrier block 1200. The servomotor 1250 is thus effective to cause relative movement to take place, lengthwise of the bottom of the shoe S supported by the shoe support 1016, between said shoe support and the tool supporting means.

As already stated, the shoe support is capable of movement radially of the turret 1012, i.e. widthwise of the bottom of a shoe S supported thereby. At the marginal roughing station C, a second servomotor 1254 mounted on the main frame of the machine at said station is engageable, through a rack-and-pinion drive arrangement (not shown), with the shoe support 1016 at that station to effect such widthwise movement of the shoe support relative to the tool supporting means. The second servomotor 1254 is thus effective to cause relative movement to take place, widthwise of the bottom of a shoe S supported by the shoe support 1016, between said shoe support and the tool supporting means.

The machine in accordance with the invention further comprises a third servomotor 1256 for effecting heightwise movement of the shoe support, and thus of the bottom of a shoe S supported thereby, at the marginal roughing station C relative to the tool supporting means. The third servomotor is mounted on the main frame of the machine at said station and carries on its output drive shaft a toothed pinion 1258 which meshes with a rack 1260 mounted for sliding heightwise movement in a bracket 1262 carried on the main frame. The rack is secured to a block 1264 which carries a rail 1266 extending widthwise of the bottom of a shoe supported by the shoe support, which rail 1266 is engaged by the roll 1102 carried by the shoe support. The rail 1266 is elongated in order to accommodate widthwise movement of the shoe support under the control of the second servomotor 1254. It will be appreciated that the third servomotor 1256 is thus effective to cause relative movement to take place, heightwise of the bottom of a shoe S supported by the shoe support, between said shoe support and the tool supporting means.

The machine also comprises a fourth servomotor 1268 which is mounted on a plate 1270 secured to the housing 1216 of the tool supporting means, which is in turn secured to the support bridge 1024 of said means. Mounted on an output drive shaft 1272 of the fourth servomotor is a toothed drive pulley 1274 operatively connected, by a toothed drive belt 1276, with a toothed annular portion of the housing 1216, said portion thus constituting a pulley integral with said housing. The centre of said annular portion 1278 lies coincident with the axis of the fulcrum shafts 1202 and also the shaft 1230 so that actuation of the fourth servomotor is effective to cause the support bridge 1240 to pivot about the axis of said fulcrum shafts 1202. In this manner, the roughing brushes 1206 are caused to pivot about said axis thus to enable the angle of presentation of the tools to the shoe bottom, during the roughing operation, to be maintained constant, or substantially so; it has been found that it is desirable if the brushes are maintained in a plane which is normal, or substantially normal, to the shoe bottom.

The roughing brushes are provided with a hood arrangement 1280 which shrouds all but an operative portion of the work-engaging surface of the brush and further which forms part of a dust extraction system by which particles which have been removed from the roughing action of the brushes from the shoe bottom can be removed from the operating locality, and also from the atmosphere.

Viewing FIG. 5, the machine in accordance with the invention also comprises brush grinding means generally designated 1290 arranged on the main frame of the machine rearwardly of the tool supporting means (in relation to a shoe supported at the marginal roughing station), said means being utilised to maintain the operating surfaces of the brushes 1206 in a sharpened condition. The brush grinding means 1290 comprises two grinding stones 1292 mounted for rotation each on its own support shaft 1294, each support shaft being mounted on one arm of a bell crank lever 1296 pivoted on a shaft 1298. The other arm of each lever 1296 carries a pin 1288 which runs in an open slot formed in a block 1300. Each block 1300 has a T-shaped portion which is accommodated in a correspondingly shaped slideway 1302 secured on the main frame of the machine. For effecting movement of the blocks 1300 towards and away from one another, thus to cause the levers 1296 to be pivoted to effect heightwise movement of the grinding stones, a connecting rod 1304 is provided having right hand and left hand threaded portions, said portions being threadedly received in the blocks 1300 and being mounted for rotational movement under the control of suitable drive means. For ensuring that the grinding stones are moved through similar amounts, said other arms of the bell crank levers 1296 have connecting rods 1306 connected thereto, intermediate their length, the connecting rods being connected, at their other ends, to a common link 1308 which is mounted for pivotal movement on the main frame of the machine. For driving the grinding stones 1292, the machine also comprises a drive motor 1310 which is mounted on the main frame and connected through a pulley (not shown) on its output drive shaft and a drive belt 1312 with a drive pulley 1314 mounted on one of the shafts 1298. Said shaft further supports a pulley 1316 which is operatively connected by a belt 1318 to drive pulleys (not shown) on the support shafts 1294 of the grinding stones.

In the operation of the machine, the tool supporting means is moved rearwardly of its rest position (as shown in FIG. 5) to a grinding position in which the brushes 1206 are located immediately beneath the grinding stones 1292. This movement is achieved by operation of the first servomotor 1250. The hood arrangement 1280 has apertures therein through which the grinding stones may enter as they are lowered into engagement with the brushes for the grinding operation.

It is desirable in the grinding operation to ensure that any burrs which are formed on the bristles of the brushes by the grinding operation are caused to project forwardly in the direction of movement of the periphery of the brushes in the roughing operation. In previous machines, the direction of rotation of the brushes has been reversed for the grinding operation; this is, however, time-consuming and further shortens the effective life of the motors driving the brushes. To avoid these problems, therefore, in a machine in accordance with the invention the brushes 1206 continue to rotate at their roughing speed and in the roughing direction and the grinding stones are caused to rotate in such a manner that, at their point of engagement the surfaces of both the brush and its associated stone are moving in the same direction, but the grinding stones move at a significantly higher speed, e.g. of the order of twice the speed of the brushes, sufficient to provide the same speed differential as is achieved in conventional machines by rotating the brushes in a reverse direction while in engagement with a stationary grinding stone.

The machine hereinbefore described is computer-controlled, the computer having a storage memory for storing digitised information relating to a number of selected styles of shoe bottom to be operated upon, the operator selecting the appropriate style for the particular shoe to be operated upon in the next cycle of operation; such selection may be through a keyboard (not shown) of the computer. The machine is arranged to operate alternately on left and right shoes, the computer thus effectively "reversing" the digitised information for the style according to whether the shoe is a left or a right. Again, the computer has a grading programme, which is operated according to the signal received from the encoder (not shown) by which the shoe length is "read", and thus according to the size of the shoe bottom to be operated upon. The grading programme is effective to vary the spacing between the digitised points not only lengthwise of the shoe bottom, but also proportionately widthwise thereof.

The computer is thus effective to control the relative positioning of the shoe bottom and the roughing brushes 1206 as the latter are caused to operate progressively along opposite marginal portions of the shoe bottom, both lengthwise, heightwise and widthwise of said shoe bottom. Thus, for each digitised point the computer supplies signals to the appropriate servomotor 1250, whereby the tool supporting means on its carrier blocks 1196, 1200 is caused to move the brushes 1206 over the shoe bottom, while simultaneously signals are supplied to the servomotor 1254 for effecting movement of the shoe support 1016 widthwise of the shoe bottom, and also to the servomotor 1256, whereby the shoe support 1016 is moved heightwise, thus to move the shoe bottom heightwise relative to the roughing tools. The computer further supplies signals to the servomotor 1268 whereby the support bridge 1204 is caused to pivot about the axis of the fulcrum shafts 1202, thus to retain the plane of the brushes normal, or substantially so, to the portion of the shoe bottom being operated upon.

In order to compensate for differences in heightwise contour between the shoe bottom as graded and the actual shoe bottom being operated upon, a feedback control system is provided which senses the amperage in one phase of the motor 1240, which is a three-phase induction motor, the amperage being proportional to the output torque of the motor. Any sensed variation in such amperage is effective to cause a signal to be passed to the computer, which in turn modulates the signals supplied thereby to the servomotor 1256, thus to vary the height of the shoe support 1016 in relation to the brush 1206 operating on the shoe bottom, whereby to bring the relative heights of the brush and shoe bottom back to a desired level, and thus to control the pressure applied by the brush to the shoe bottom. Furthermore, by this method, the torque loading of the motor, and thus the pressure applied by the brush to the shoe bottom, can be pre-set according to the degree of roughing required or according to the materials from which the shoe upper is made. In addition, if desired, the pressure applied by the brush to a shoe bottom may be varied during the roughing operation, e.g. in order to compensate for different materials used in the forepart and backpart of the shoe upper, by appropriately programming the computer.

A significant advantage of controlling the heightwise position of the brushes in relation to the shoe bottom by a servomotor as aforesaid is that the bottoms of shoes the uppers of which are constituted by straps, e.g. sandals, can be roughed in the operation of the machine, without damaging, by roughing, the portions of the insole exposed between the lasted-over strap portions.

When an operating cycle of the machine is initiated at the marginal roughing station C, the tool supporting means 1194 is thus caused to move lengthwise of the shoe bottom under the control of the computer, while the shoe support is moved widthwise and heightwise of said shoe bottom, thus to cause each of the brushes 1206 to operate progressively along a marginal portion of the bottom of a shoe S supported in the shoe support.

In the operation of the machine hereinbefore described, the computer programme is arranged to cause the marginal portion of the outer side of the bottom of the shoe S supported by the shoe support at the marginal roughing station C first to be roughed from the heel end to the toe end thereof and thereafter the marginal portion of the inner side of said shoe bottom to be roughed from the toe end to the heel end thereof. Thus, with a left shoe supported by the shoe support (as shown in FIG. 5), the left-hand brush (viewing FIG. 6) is first caused to operate along the left-hand side portion of the shoe bottom, from the heel end to the toe end thereof, said brush being caused to rotate anti-clockwise (viewing FIG. 6) thus to cause the brush to effect an in-wiping action along the side portion as it operates progressively therealong. When the left-hand brush reaches to toe end of the shoe bottom, the shoe support is moved widthwise of the shoe bottom and the right-hand brush (viewing FIG. 6) then engages the shoe bottom and is caused to operate progressively along the right-hand side portion of the shoe bottom from the toe end to the heel end thereof, the right-hand brush being caused to rotate clockwise (viewing FIG. 6) so that it also effects an in-wiping action on the side portion of the shoe bottom as it operates progressively therealong. When a right shoe is upported by the shoe support, on the other hand, the right-hand brush (viewing FIG. 6) is first caused to operate along the right-hand side portion of the shoe bottom from the heel end to the toe end thereof, and thereafter the left-hand brush is caused to operate along the left-hand side portion of said shoe bottom from the toe end to the heel end thereof, the direction of rotation of each brush nevertheless causing an in-wiping action to be effected on the marginal portions of said shoe bottom during the roughing operation.

It will thus be appreciated that, in using the machine as hereinbefore described, a shoe can be operated upon, once its style has been digitised as aforesaid and stored in the computer memory, without the need for a metal template or other mechanical guidance device, and further without relying on the shoe bottom shape itself as a guide; in this way, shoes having strap uppers can be operated upon as readily as shoes having full uppers. Furthermore, by providing a grading programme in the computer and means for measuring the length of the shoe placed in the shoe support, from a single set of digitised points relating to a shoe of known size and hand, shoes of the same style, whether lefts or rights, can be operated upon without any requirement for the operator to feed additional information to the computer.

A further advantage over known shoe bottom roughing machines resides in that, by utilising one roughing brush as relative movement lengthwise of the shoe bottom is effected in a first direction and using the other roughing brush while such movement is effected in the opposite direction, the time required to traverse the shoe bottom is significantly reduced, thereby enhancing the output of the machine in a working shift. Simplifying the mounting of the roughing brushes, which can also be achieved when using such an operating arrangement, also enables the brushes to be more readily pivoted about a horizontal axis, thus to control the angle of presentation of the operating surface of the roughing brush to the shoe bottom; this leads not only to improved roughing, but also to more even wear of the operating surface of the brush, and thus to a longer life for each brush, and further enables high-heeled shoes to be operated upon more readily.

Again, a further advantage of the machine as hereinbefore described resides in the provision of rotating brush grinding stones and the consequent absence of the need to stop the rotation of the brushes and reverse it prior to a grinding operation. This arrangement, as already stated, leads to less strain on the motor driving the brushes and thus to a longer life therefor. Also, by keeping the brushes in a uniformly, relatively sharp condition, the roughing action should be more consistent in successive shoes and also requires less force against the brush, as compared to existing machines when the brushes dull between occasional grinding operations.

Further, by always causing the roughing operation to be effected from the heel end to the toe end along the outer side of the marginal portion of a shoe bottom, and from the toe end to the heel end along the inner side of the shoe bottom, regardless of whether the shoe is a left or a right, it will be appreciated that opposite edges of each brush will be "leading" in the roughing operation in alternate cycles of operation of the machine, since the machine operates alternately on lefts and rights. In this way, agains, wear on the operating surfaces of the brushes is rendered more even, thus contributing to extending the life of each brush.

Still further, by relieving the operator of the requirement of carrying out a prior manual toe scouring operation between successive initiations of a machine cycle, namely by incorporating toe scouring in the machine, the cycle time of the machine operation is no longer constrained by such requirement, and can thus be shortened, and further the operator is rendered free to concentrate on achieving maximum output of the machine.

From the foregoing it is to be appreciated that a preferred embodiment has been disclosed for an apparatus for operating progressively along marginal portions of shoe bottoms. It is of course to be appreciated that alternative structures may be substituted for the elements of the preferred embodiment without departing from the scope of the present invention.

We claim:

1. A machine for performing a roughing operation progressively along marginal portions of shoe bottoms comprising a shoe support, tool supporting means, means for effecting relative movement, lengthwise of the bottom of a shoe supported by the shoe support, between said shoe support and the tool supporting means first in one direction and then in an opposite direction, and means, operable as relative lengthwise movement takes place as aforesaid, for effecting relative movement, widthwise of the bottom of a shoe supported by the shoe support, between said shoe support and the tool supporting means, whereby, in the operation of the machine, a roughing operation can be progressively performed along marginal portions of such shoe bottom, wherein the tool supporting means is arranged to support two radial roughing tools for operating along opposite marginal portion of the shoe bottom, each tool being caused to effect an in-wiping action on the marginal portion on which it is caused to operate, and further wherein, in a cycle of operation of the machine, one of said tools is caused to operate along the marginal portion of the shoe bottom at one side thereof during relative lengthwise movement as aforesaid in said one direction, and the other of said tools is caused to operate along the marginal portion of such shoe bottom at the opposite side thereof during said relative lengthwise movement in said opposite direction.

2. A machine according to claim 1 wherein the shoe support is so arranged that, as relative lengthwise movement is effected in said one direction, said one tool is caused to operate beginning at the heel end of the shoe bottom, while the other tool is caused to operate beginning at the toe end of the shoe bottom as such relative lengthwise movement is effected in the opposite direction, the arrangement being such that, in a cycle of operation of the machine, said one tool is caused to operate first and the other tool thereafter.

3. A machine according to claim 1 or claim 2 wherein the tool supporting means comprises a single support member by which both roughing tools are supported.

4. A machine according to claim 3 wherein the tools are supported side-by-side by said support member.

5. A machine according to claim 3 wherein the means for effecting relative movement, lengthwise of the bottom of a shoe supported by the shoe support, between the tool supporting means and the shoe support comprises a servomotor operable under the control of computer means.

6. A machine according to claim 5 wherein the tool supporting means is mounted for movement relative to the shoe support in a direction extending lengthwise of the bottom of a shoe supported by the shoe support.

7. A machine according to claim 5 wherein the means for effecting relative movement, widthwise of the bottom of a shoe supported by the shoe support, between the tool supporting means and the shoe support also comprises a servomotor operable under the control of computer means.

8. A machine according to claim 6 wherein the shoe support is mounted for movement relative to the tool supporting means in a direction extending widthwise of the bottom of a shoe supported thereby.

9. A machine according to claim 3 wherein means is provided by which relative movement, heightwise of the shoe bottom, can be effected between the shoe support and the tool supporting means, so as to control the position of each tool relative to the shoe bottom, each tool supported by the tool supporting means thus being caused to follow the heightwise contour of the shoe bottom as it is caused to operate along marginal portions thereof as aforesaid.

10. A machine according to claim 9 wherein said means for effecting relative heightwise movement as aforesaid comprises a servomotor operable under the control of computer means.

11. A machine according to claim 10 wherein the shoe support is mounted for movement relative to the tool supporting means in a direction extending heightwise of the bottom of a shoe supported thereby.

12. A machine according to claim 3 wherein the tool supporting means is mounted for pivotal movement about a horizontal axis.

13. A machine according to claim 12 wherein means is provided for effecting pivotal movement of the tools as aforesaid, said means comprising a servomotor operable under the control of computer means.

14. A machine for operating progressively along marginal portions of shoe bottoms comprising a shoe support for supporting a shoe, bottom uppermost, with a marginal portion to be operated upon of the bottom thereof exposed, tool supporting means for supporting an operating tool, a first servomotor for effecting relative movement, lengthwise of the bottom of a shoe supported by the shoe support, between said shoe support and the tool supporting means, a second servomotor for effecting relative movement, widthwise of such shoe bottom, between the shoe support and the tool supporting means, and a third servomotor for effecting relative movement, heightwise of such shoe bottom, between the shoe support and the tool supporting means, the machine also comprising computer control means for controlling the operation of each servomotor in accordance with digitised co-ordinate axis values, using three co-ordinate axes, for a plurality of successive selected points along the marginal portion to be operated upon of a shoe bottom.

15. A machine according to claim 14 wherein the tool supporting means has associated therewith sensing means by which the pressure applied by the tool supported thereby to the bottom of a shoe being operated upon can be gauged and which, in response to changes in such pressure, is effective to supply control signals to the computer control means which is thus caused to modulate the signals supplied thereby to the third servomotor.

16. A machine for performing a progressive operation along marginal portions of shoe bottoms, comprising a shoe support, tool supporting means, and means for effecting relative movement, both lengthwise and widthwise of the bottom of a shoe supported by the shoe support, between the shoe support and the tool supporting means whereby a tool supported by the tool supporting means is caused to operate progressively along a marginal portion of the shoe bottom, the machine also comprising means whereby the heightwise position of such tool, as it is caused to operate as aforesaid, relative to the shoe bottom is varied according to the heightwise contour of the shoe bottom, wherein the last-mentioned means comprises a servomotor operable under the control of computer means, in accordance with digitised co-ordinate axis values, using three co-ordinate axes, for a plurality of successive selected points along the marginal position to be operated upon of a shoe bottom, thus to cause the heightwise position of the tool in relation to the shoe support to be determinatively controlled, and further wherein the tool supporting means has associated therewith sensing means by which the pressure applied by the tool supported thereby to the bottom of a shoe being operated upon can be gauged and which, in response to changes in such pressure, is effective to supply control signals to the computer control means which is thus caused to modulate the signals supplied thereby to the stepping motor.

17. A machine according to claim 14 wherein a fourth servomotor is provided by means of which the tool supporting means is caused to pivot about a horizontal axis thus to vary the angle of presentation between the tool and the shoe bottom, said servomotor also being supplied with signals by the computer control means, in accordance with a digitised co-ordinate axis values for a plurality of selected points along the shoe bottom marginal portion to be operated upon.

18. A machine according to claim 16 wherein the operating tool is caused to rotate by a motor, and wherein the sensing means senses the output torque of said motor as it rotates in engagement with the shoe bottom.

19. A machine according to claim 17 wherein said motor is a three-phase induction motor, and the sensing means senses the amperage of one of the phases.

20. A machine according to claim 16 wherein the pressure applied by the tool to the shoe bottom can be regulated.

21. A machine according to claim 14 wherein operations are performed alternately on left and right shoes, the computer means effectively "reversing" the digitised information for each machine cycle.

22. A machine according to claim 14 wherein means is provided by which the length of a shoe supported by the shoe support is "read", said means controlling the amount of relative movement, lengthwise of the shoe bottom, between the tool supporting means and the shoe support.

23. A machine according to claim 22 wherein said means comprises an encoder.

24. A machine according to claim 22 wherein the computer control means includes a grading programme whereby the paths of relative movement, lengthwise, widthwise and heightwise of the shoe bottom, between the tool supporting means and the shoe support are graded according to the "reading" of the length of the shoe.

25. A machine adapted for use in the manufacture of shoes comprising a rotary turret arrangement carrying a plurality of shoe supports each capable of supporting, bottom up, a lasted shoe, means for indexing the turret to bring each shoe support successively to a series of operating stations, including a roughing station at which a roughing operation can be performed progressively along opposite marginal portions of the bottom of a lasted shoe supported by the shoe support at said station, said station comprising tool supporting means by which a radial roughing tool can be supported and means for moving the tool supporting means relative to the shoe support in a direction extending lengthwise of the shoe bottom, and wherein the shoe support is mounted on the turret for movement relative thereto in a direction extending widthwise of the shoe bottom, whereby, in the operation of the machine, the tool supported by the tool supporting means is caused to operate progressively along a marginal portion of the bottom of the shoe supported by the shoe support.

26. A machine according to claim 25 wherein the shoe support is also mounted on the turret for movement relative thereto in a direction extending heightwise of the shoe bottom.

27. A machine according to claim 25 wherein another of the operating stations is a scouring station which is arranged "upstream" of the roughing station and at which the toe portion of a lasted shoe can be scoured by means of a rotary scouring tool, means being provided for effecting relative movement between said scouring tool and the shoe support in a direction extending lengthwise of the shoe bottom.

28. A machine according to claim 27 wherein means is provided, at the scouring station, for "reading" the angle of inclination of the toe end of the bottom of the shoe supported by the shoe support at said station, said means controlling the angular disposition of a cam member by which the heightwise position of the scouring tool in relation to the shoe support, as relative movement is effected therebetween as aforesaid, can be controlled.

29. A machine for performing marginal roughing and also toe scouring operations on shoe bottoms comprising a shoe support and roughing tool supporting means, between which relative movement can take place, in directions extending lengthwise, widthwise and heightwise of the bottom of a shoe supported by the shoe support whereby a roughing tool supported by the roughing tool supporting means can be caused to operate progressively along a marginal portion of the bottom of a shoe supported by the shoe support, the machine also comprising scouring tool supporting means between which and the shoe support relative movement can also take place in directions extending lengthwise and heightwise of the bottom of a shoe supported by the shoe support, means also being provided, responsive to the heightwise contour of the toe portion of the shoe bottom, for controlling the relative heightwise movement between the shoe support and the scouring tool supporting means as relative lengthwise movement is caused to take place therebetween.

30. A machine according to claim 29 wherein the means responsive to the heightwise contour of the shoe bottom comprises a shoe bottom engaging member pivotally mounted on a shaft on which a cam member is also secured, the angular disposition of which cam member is set by pivoting the shoe bottom engaging member into engagement with the shoe bottom at the toe end thereof, the cam member being effective, as relative lengthwise movement is caused to take place between the scouring tool supporting means and the shoe support, to cause relative heightwise movement to take place therebetween.

31. A machine for performing a roughing operation progressively along marginal portions of shoe bottoms comprising a shoe support, tool supporting means, for supporting a roughing tool in the form of a rotary wire brush, and means whereby relative movement can take place, in directions extending lengthwise, widthwise and heightwise of the bottom of a shoe supported by the shoe support, between the tool supporting means and the shoe support whereby a tool supported by the tool supporting means can operate progressively along the bottom of a shoe supported by the shoe support, wherein grinding means is provided by which the operating surface of the roughing tool can be ground to maintain its roughing capability, the grinding means comprising a rotary grinding member, and further wherein first and second drive means are provided for causing the tool and the grinding member respectively to rotate, the arrangement being such that, at the point of engagement between the tool and the grinding member, the operating surfaces thereof are moving in the same direction, but the speed of the surface of the grinding member is greater than that of the surface of the tool.

32. A machine according to claim 30 wherein the speed of rotation of the tool is maintained substantially constant during roughing operations and tool grinding, and wherein during tool grinding the speed of the surface of the grinding member is of the order of twice that of the surface of the tool.

* * * * *